US009810186B2

(12) United States Patent
Mansour et al.

(10) Patent No.: US 9,810,186 B2
(45) Date of Patent: Nov. 7, 2017

(54) DIRECT INJECTION MULTIPOINT NOZZLE

(71) Applicant: Parker-Hannifin Corporation, Cleveland, OH (US)

(72) Inventors: Adel B. Mansour, Mentor, OH (US); Michael Teter, Madison, OH (US); Erlendur Steinthorsson, Pepper Pike, OH (US); Brian P. Hollon, Moncks Corner, SC (US); Jeffery R. Lehtinen, Concord Township, OH (US); Raman Ras, Concord, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 94 days.

(21) Appl. No.: 14/758,633

(22) PCT Filed: Dec. 31, 2013

(86) PCT No.: PCT/US2013/078431
§ 371 (c)(1),
(2) Date: Jun. 30, 2015

(87) PCT Pub. No.: WO2014/130161
PCT Pub. Date: Aug. 28, 2014

(65) Prior Publication Data

US 2015/0354517 A1 Dec. 10, 2015

Related U.S. Application Data

(60) Provisional application No. 61/748,308, filed on Jan. 2, 2013.

(51) Int. Cl.
*F23D 11/00* (2006.01)
*F02M 53/04* (2006.01)
(Continued)

(52) U.S. Cl.
CPC ..... *F02M 53/046* (2013.01); *F02M 53/08* (2013.01); *F02M 61/162* (2013.01);
(Continued)

(58) Field of Classification Search
CPC .... F02M 53/046; F02M 53/08; F02M 61/162; F23D 11/103; F23D 2900/11002; F23R 3/28
(Continued)

(56) References Cited

U.S. PATENT DOCUMENTS 6,289,677 B1 9/2001 Prociw et al.
6,298,667 B1 10/2001 Glynn et al.
(Continued)

FOREIGN PATENT DOCUMENTS

EP 1167882 1/2002
EP 2003398 12/2008

OTHER PUBLICATIONS

International Search Report and Written Opinion for corresponding Patent Application No. PCT/US2013/078431 dated Oct. 7, 2014.
(Continued)

*Primary Examiner* — Viet Le
(74) *Attorney, Agent, or Firm* — Renner, Otto, Boisselle & Sklar, LLP

(57) ABSTRACT

Provided is an injector (30) having a plurality of injector modules (44) that include a spray cup having a chamber and a plurality of radial air passages for directing air radially into the chamber, and a pressure swirl atomizer attached to the spray cup and having a fluid passage for directing fluid axially into chamber and an air passage for directing air axially into the chamber. By providing radial and axial air flow and axial fuel flow into the chamber, the fuel may be mixed to prevent local hot spots that lead to high NOx emissions, and a stable flame may be maintained without
(Continued)

autoignition and flashback. The axial air flow also prevents recirculation zones from forming at a base of the spray cup, provides improved atomization and enhanced combustion.

19 Claims, 13 Drawing Sheets

(51) Int. Cl.
*F02M 53/08* (2006.01)
*F02M 61/16* (2006.01)
*F23D 11/10* (2006.01)
*F23R 3/28* (2006.01)

(52) U.S. Cl.
CPC ..... *F23D 11/103* (2013.01); *F23R 3/28* (2013.01); *F23D 2900/11002* (2013.01)

(58) Field of Classification Search
USPC ..... 239/403
See application file for complete search history.

(56) References Cited

U.S. PATENT DOCUMENTS

| | | | | |
|---|---|---|---|---|
| 7,021,562 | B2 * | 4/2006 | Mansour | F23D 11/383 239/399 |
| 7,237,730 | B2 * | 7/2007 | Prociw | F23D 11/107 239/403 |
| 7,509,813 | B2 * | 3/2009 | Stastny | F23R 3/50 60/752 |
| 2004/0124282 | A1 | 7/2004 | Mansour et al. | |

OTHER PUBLICATIONS

Written Opinion for corresponding Patent Application No. PCT/US2013/078431 dated Mar. 11, 2015.
Notification concerning informal communications with the applicant for corresponding Patent Application No. PCT/US2013/078431 dated May 26, 2015.

* cited by examiner

DIRECT INJECTION MULTIPOINT NOZZLE

RELATED APPLICATIONS

This application is a national phase of International Application No. PCT/US2013/078431 filed on Dec. 31, 2013 and published in the English language, which claims the benefit of U.S. Provisional Application No. 61/748,308 filed Jan. 2, 2013, which are all hereby incorporated herein by reference.

FIELD OF INVENTION

The present invention relates generally to turbine engines, and more particularly to injectors for turbine engines having a plurality of direct injection multipoint nozzles.

BACKGROUND

A turbine engine typically includes an outer casing extending radially from an air diffuser and a combustion chamber. The casing encloses a combustor for containment of burning fuel. The combustor includes a liner and a combustor dome, and an igniter is mounted to the casing and extends radially inwardly into the combustor for igniting fuel.

The turbine also typically includes one or more fuel injectors for directing fuel from a manifold to the combustor. Fuel injectors also function to prepare the fuel for mixing with air prior to combustion. Each injector typically has an inlet fitting connected either directly or via tubing to the manifold, a tubular extension or stem connected at one end to the fitting, and one or more spray nozzles connected to the other end of the stem for directing the fuel into the combustion chambers. A fuel passage (e.g., a tube or cylindrical passage) extends through the stem to supply the fuel from the inlet fitting to the nozzle. Appropriate valves and/or flow dividers can be provided to direct and control the flow of fuel through the nozzle. The fuel injectors are often placed in an evenly-spaced annular arrangement to dispense (spray) fuel in a uniform manner into the combustion chamber. Additional concentric and/or series combustion chambers each require their own arrangements of nozzles that can be supported separately or on common stems. The fuel provided by the injectors is mixed with air and ignited, so that the expanding gases of combustion can, for example, move rapidly across and rotate turbine blades in a gas turbine engine to power an aircraft, or in other appropriate manners in other combustion applications.

SUMMARY OF INVENTION

The present invention provides an injector having a plurality of injector modules that include a spray cup having a chamber and a plurality of radial air passages for directing air radially into the chamber, and a pressure swirl atomizer attached to the spray cup and having a fluid passage for directing fluid axially into chamber and an air passage for directing air axially into the chamber. By providing radial and axial air flow and axial fuel flow into the chamber, the fuel may be mixed to prevent local hot spots that lead to high NOx emissions, and a stable flame may be maintained without autoignition and flashback. The axial air flow also prevents recirculation zones from forming at a base of the spray cup, provides improved atomization and enhanced combustion.

According to one aspect of the invention, an injector is provided that includes a housing having a fluid channel for fluid, a plurality of injector modules fluidly connected to the fluid channel, each injector module including a spray cup having first and second open ends, a chamber defined between the ends, and a plurality of radial air passages extending through the spray cup for directing air radially inwardly into the chamber, and a pressure swirl atomizer attached to the spray cup at the first end, the pressure swirl atomizer including a body having a tip extending into the chamber, a fluid passage extending through the body for directing fluid in an axial direction into the chamber, and at least one air passage radially outwardly spaced from the fluid passage for directing air in the axial direction into the chamber, and a heatshield assembled to a downstream end of each injector module, the heatshield including a body for protecting the injector modules from combustion heat and a plurality of apertures located so as to allow the fluid from a corresponding injector module to be dispensed from the spray cup.

The plurality of apertures are spaced along a length of the heatshield in a direction perpendicular to the axial direction.

The plurality of injector modules are spaced from one another in the direction perpendicular to the axial direction along the length of the heatshield such that the injector modules float radially relative to an adjacent one of the plurality of injector modules.

The at least one air passage of each pressure swirl atomizer includes a plurality of circumferentially spaced air passages.

Each pressure swirl atomizer includes a plurality of projections extending radially outwardly from the body, and wherein the air passages are formed between adjacent ones of the plurality of projections.

The plurality of projections are angled relative to the axis of the spray cup to swirl the air in the air passage.

The plurality of radial air passages of each spray cup are circumferentially spaced.

The plurality of circumferentially spaced radial air passages include a plurality of sets of circumferentially spaced passages axially spaced from one another.

The air from the radial air passages and the axial air passage of each injector module combines with the fluid from the respective fluid passage and is directed out of the spray cup through the second open end.

According to another aspect of the invention, an injector module is provided that includes a spray cup having first and second open ends, a chamber defined between the ends, and a plurality of radial air passages extending through the spray cup for directing air radially inwardly into the chamber, and a pressure swirl atomizer attached to the spray cup at the first end, the pressure swirl atomizer including a body having a tip extending into the chamber, a fluid passage extending through the body for directing fluid in an axial direction into the chamber, and at least one air passage radially outwardly spaced from the fluid passage for directing air in the axial direction into the chamber.

The at least one air passage includes a plurality of circumferentially spaced air passages.

The pressure swirl atomizer includes a plurality of projections extending radially outwardly from the body, and wherein the air passages are formed between adjacent ones of the plurality of projections.

The plurality of projections are angled relative to the axis of the spray cup to swirl the air in the air passage.

The spray cup includes a flange extending radially outwardly from the second end.

The flange includes a plurality of air cooling holes for stagnation flow

The plurality of radial air passages are circumferentially spaced.

The plurality of circumferentially spaced radial air passages include a plurality of sets of circumferentially spaced passages axially spaced from one another.

The tip of the pressure swirl atomizer is conical.

The spray cup diverges from the first end to the second end.

The air from the radial air passages and the axial air passage combines with the fluid from the fluid passage and is directed out of the spray cup through the second open end.

The pressure swirl atomizer includes an inner body defining the fluid passage and an outer body surrounding the inner body, the outer body being attached to the first end of the spray cup.

A heatshield gap is provided between the inner and outer bodies heat shielding the fluid in the fluid passage to isolate the fluid from air surrounding the outer body.

According to another aspect of the invention, a plurality of injector modules are provided, each injector module including a spray cup having first and second open ends, a chamber defined between the ends, and a plurality of radial air passages extending through the spray cup for directing air radially inwardly into the chamber, and a pressure swirl atomizer attached to the spray cup at the first end, the pressure swirl atomizer including a body, a fluid passage extending through the body for directing fluid in an axial direction into the chamber, and at least one air passage radially outwardly spaced from the fluid passage for directing air in the axial direction into the chamber.

The plurality of injector modules are spaced from one another in a direction perpendicular to the axial direction such that the injector modules float radially relative to an adjacent one of the plurality of injector modules.

The body of each pressure swirl atomizer has a tip extending into the chamber of the spray cup.

According to still another aspect of the invention, an injector for distributing liquid sprays is provided, the injector including an inlet fitting including a port for receiving liquid, a stem supported by the fitting, the stem including an internal circuit fluidly connected to the port, at least one flow plate supported by the stem, the at least one flow plate including an internal passage connected to the internal circuit in the stem, a plurality of pressure swirl atomizers each having an upstream end attached to the at least one flow plate, a downstream end, and a fluid passage extending therethrough that is fluidly connected to the internal passage, a plurality of spray cups each having an upstream end attached to the downstream end of one of the plurality of pressure swirl atomizers, a downstream end, and a chamber into which the downstream end of one of the pressure swirl atomizers extends, and a heatshield attached to the downstream end of each of the plurality of spray cups.

The foregoing and other features of the invention are hereinafter described in greater detail with reference to the accompanying drawings.

DETAILED DESCRIPTION

The principles of the present application have particular application to injectors for turbine engines and thus will be described below chiefly in this context. It will of course be appreciated, and also understood, that the principles of the invention may be useful in other applications where fluid, such as fuel, is mixed with air and distributed.

Figure 1:
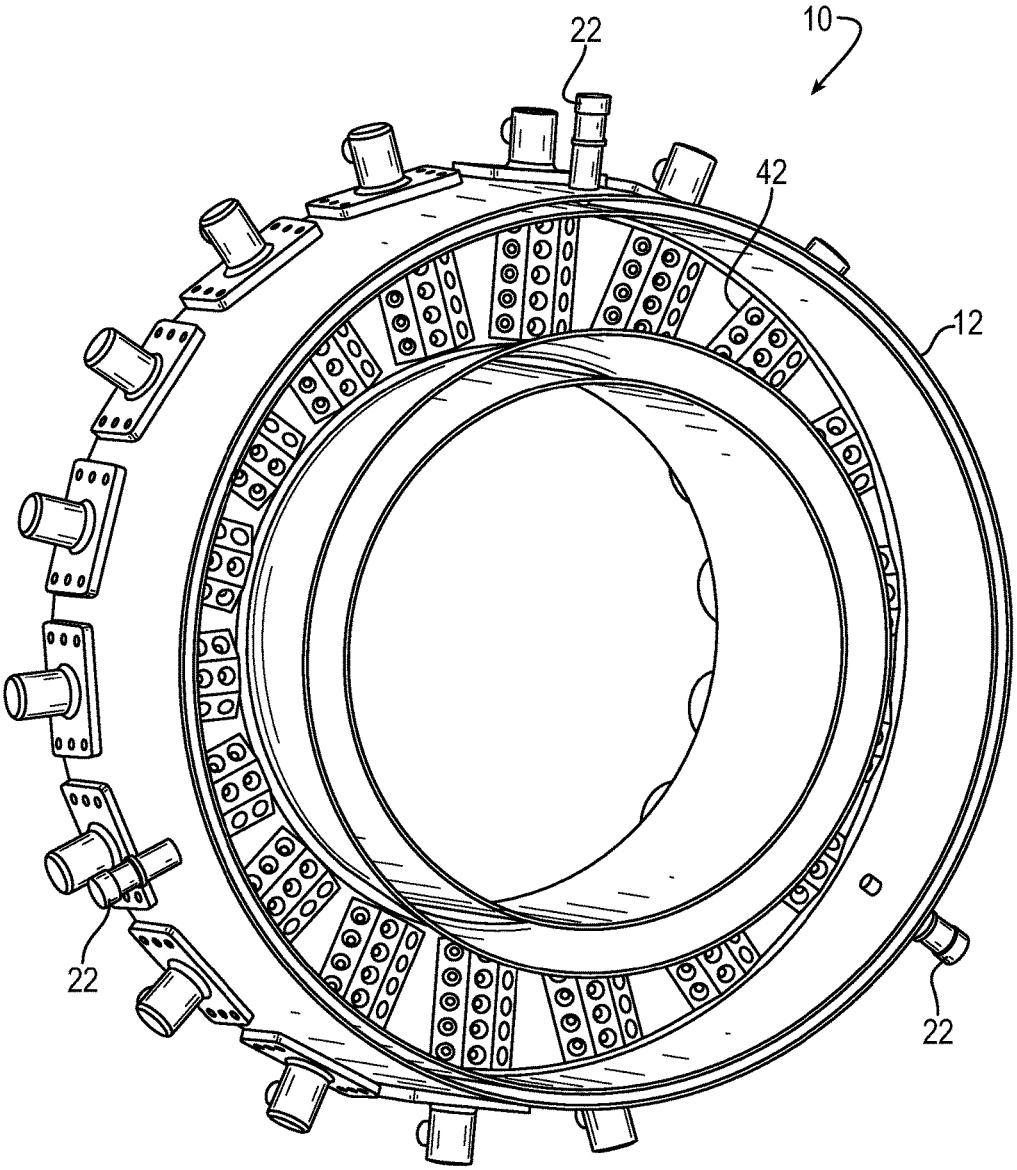
FIG. 1 is a perspective view of an exemplary combustor and a plurality of fuel injectors for a turbine engine.
Figure 2:
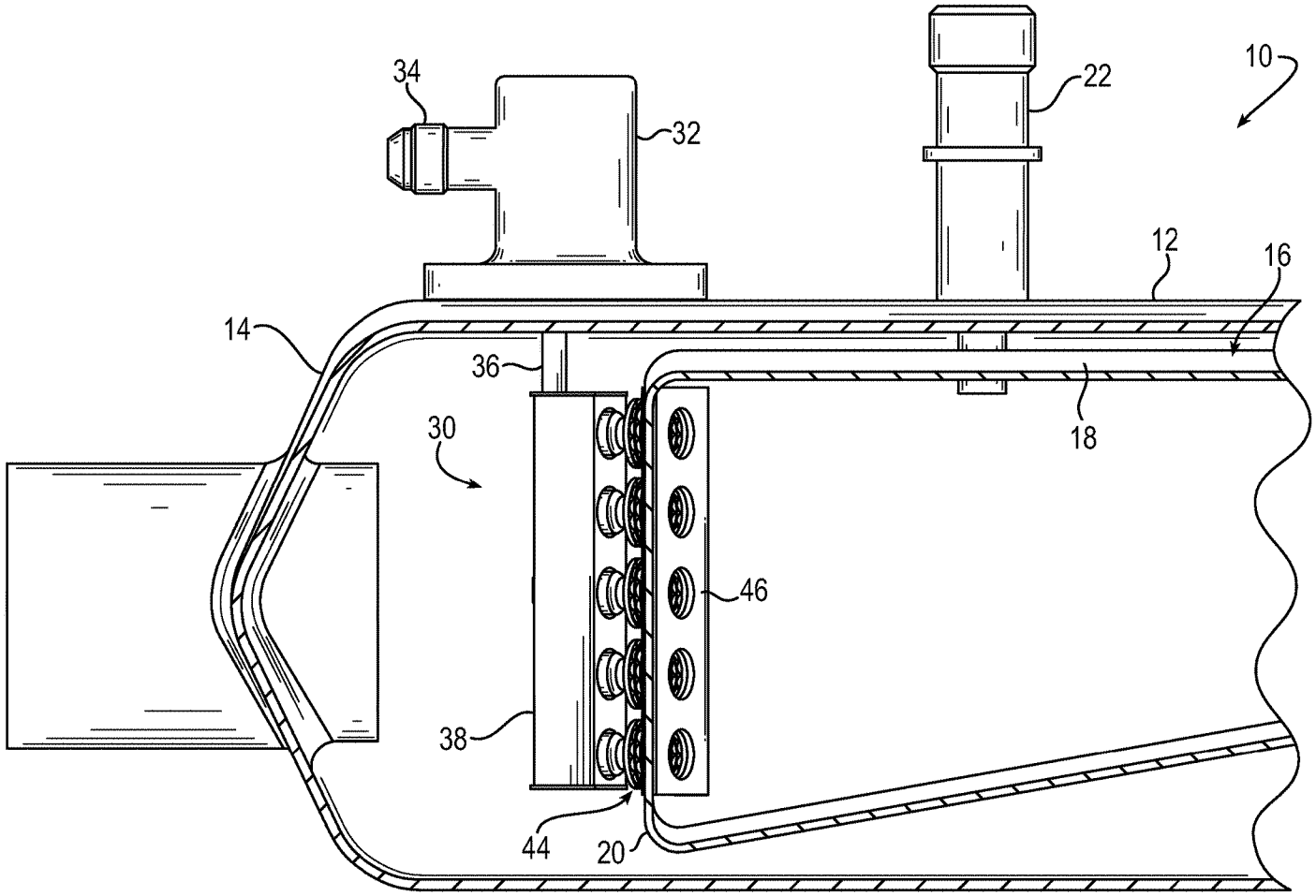
FIG. 2 is a fragmentary cross-sectional view of a portion of the turbine engine illustrating a fuel injector in communication with the combustor.
Figure 3:
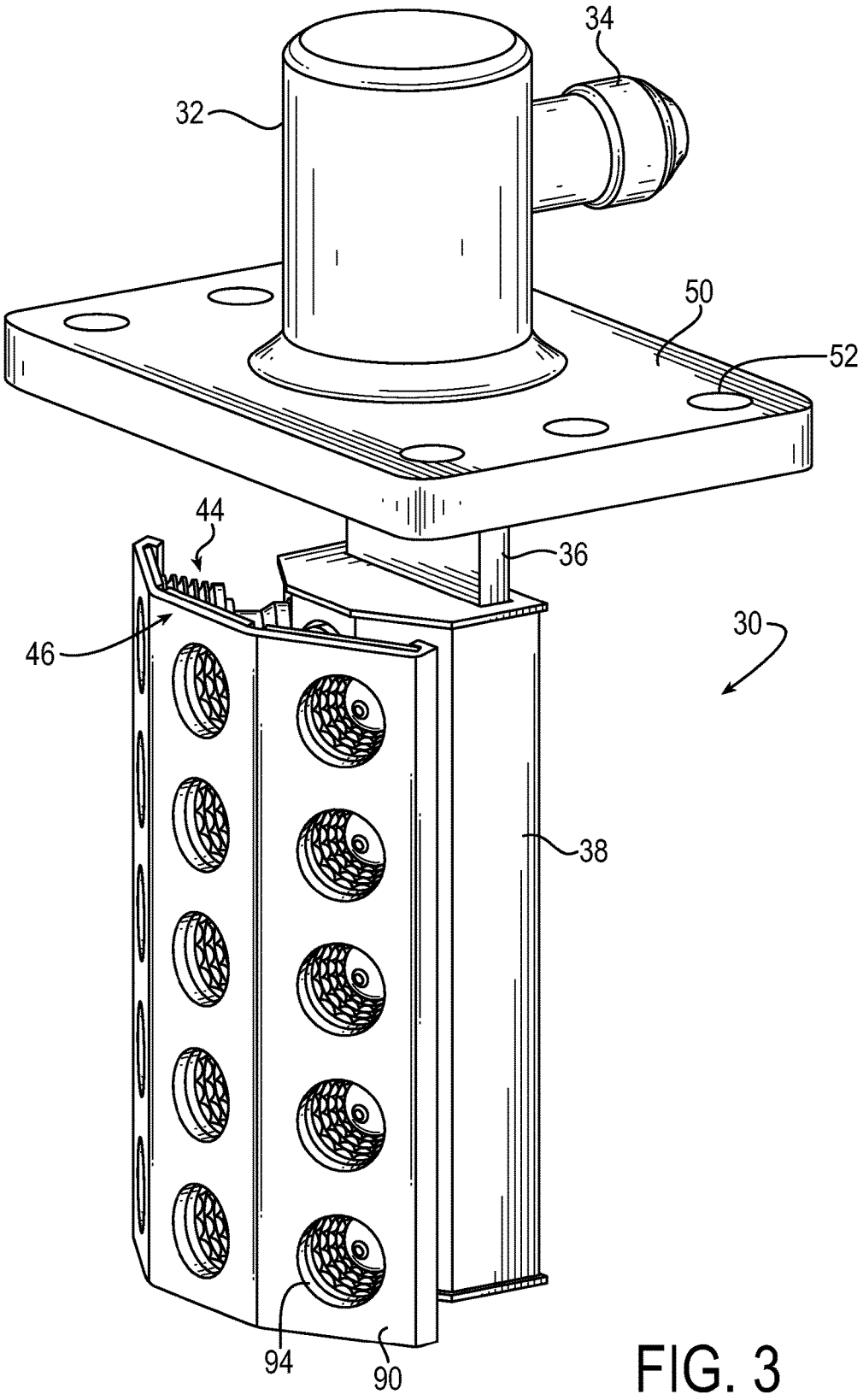
FIG. 3 is a perspective view of the exemplary fuel injector according to the invention.
Figure 4:
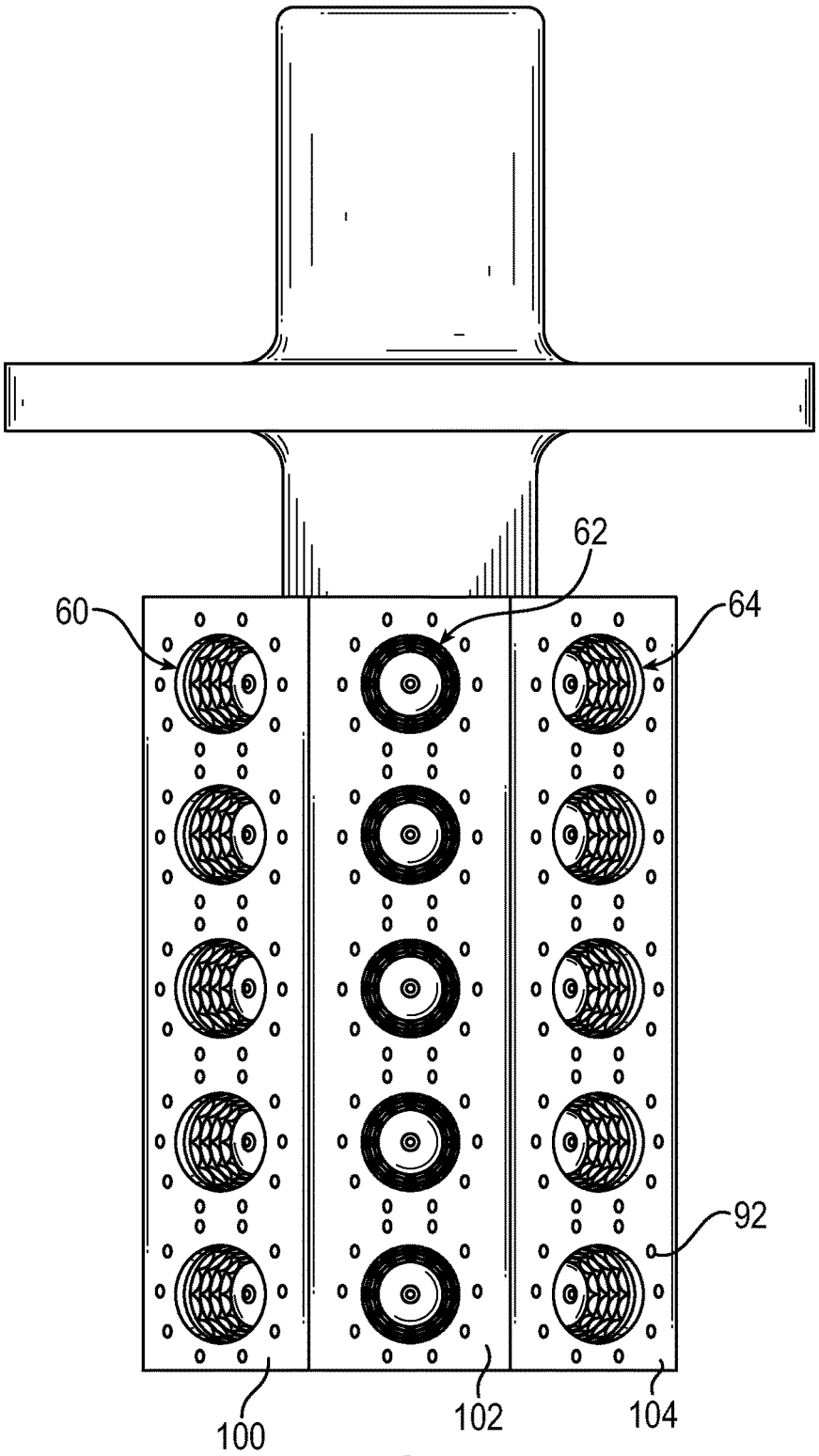
FIG. 4 is a front view of the exemplary fuel injector.
Figure 5:
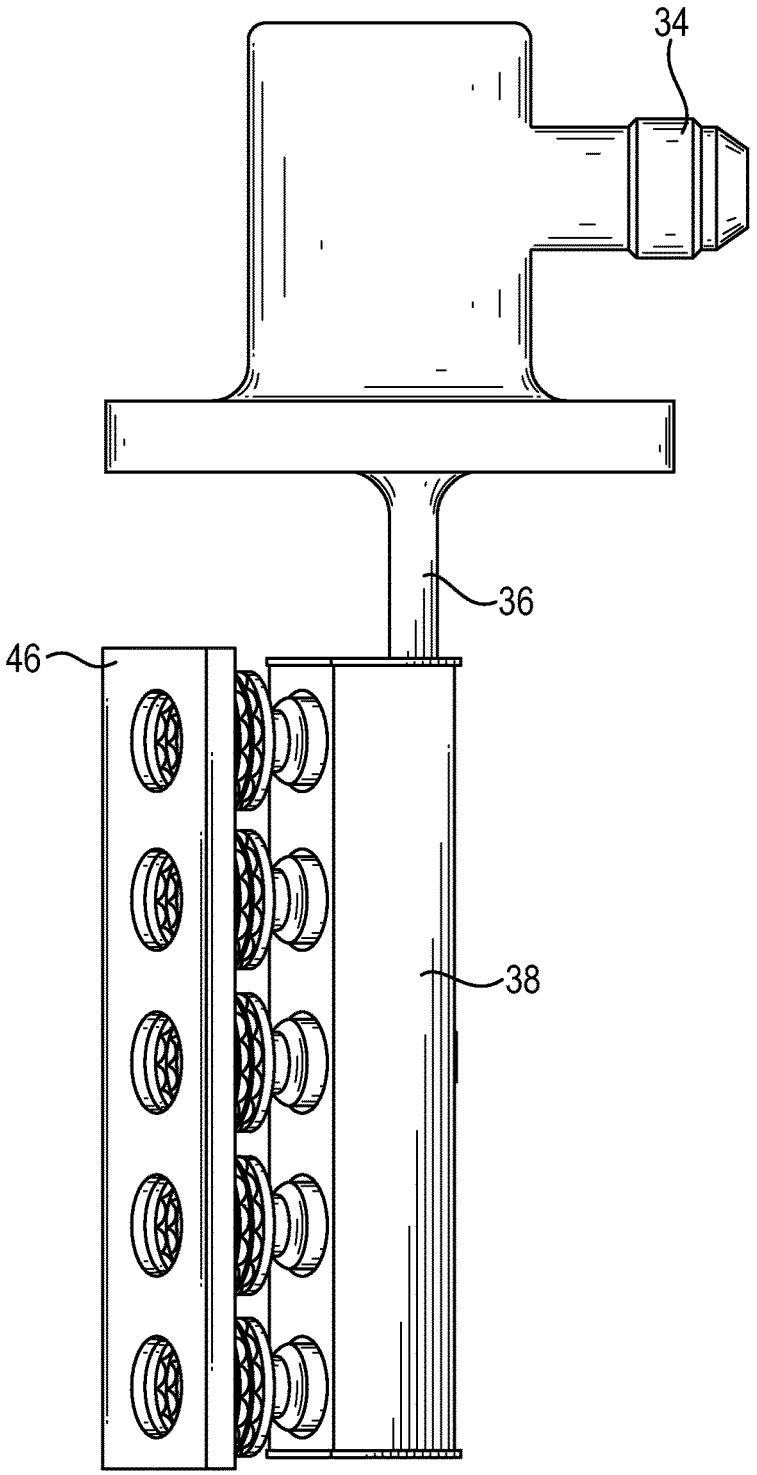
FIG. 5 is a side view of the exemplary fuel injector.

Referring now in detail to the drawings and initially to FIGS. 1 and 2, a turbine engine for an aircraft is illustrated generally at 10. The turbine engine 10 includes an outer casing 12 extending forwardly of an air diffuser 14. The casing 12 and diffuser 14 enclose a combustor 16 for containment of burning fuel. The combustor 16 includes at least one liner 18 configured to direct fuel into the combustor 16 and a combustor dome 20 at an upstream end of the liner 18. An igniter 22, and in the illustrated embodiment a plurality of igniters are mounted to the casing 12 and extends inwardly into the combustor 16 for igniting fuel.

A fuel injector, indicated generally at 30, is received within an aperture formed in the casing 12 and extends into the combustor 16. As shown in FIG. 1, a plurality of fuel injectors 30 is arranged circumferentially around the combustor 16. Each fuel injector 30 includes a valve housing 32 exterior of the casing 12, the valve housing having a port 34 for receiving fluid, for example from a fuel manifold or line, an in an embodiment multiple ports. A stem 36 is supported by the valve housing 32 and includes an internal circuit fluidly connected to the port 34. A housing 38, which serves as a heatshield, is supported by the stem 36 and partially surrounds the stem 36.

Attached to the stem 36 and also surrounded by the heatshield is at least one plate, and as shown first and second flow plates 40 and 42 (FIG. 6) having an internal passage connected to the internal circuit in the stem assembly 36. Attached to the second plate 40 and extending through the housing 38 is a plurality of micro-mixing injector modules 44 (micro-mixing nozzles), each injector module 44 having a fluid passage fluidly connected to the internal passage. Attached to the injector modules 44 is a heatshield 46. The injector modules 44 and heatshields 46 extend into the combustor 16.

A plurality of rectangular, radially-extending openings may be formed in the dome 20 in an evenly spaced-apart arrangement around the dome 20 and corresponding to locations of openings through which the stem 36 extends for the injector modules 44 and heatshields 46 to extend through. The heatshields 46 interface with the dome 20 to provide an axial seal that is loaded with a pressure drop during operation to control air leakage. It will be appreciated that while a number of injectors 30 are shown in an evenly-spaced annular arrangement, the number and location, and spacing of the injectors 30 may vary depending upon the application.

Turning now to FIGS. 3-7, the fuel injectors 30 each include a flat, radially extending injector mount or flange 50 adapted to be fixed and sealed to the outer surface of the outer casing 12 with appropriate fasteners received in openings 52. The valve housing 32 is integral with or fixed to the flange 50, such as by brazing or welding, and projects outwardly from the flange 50, and the stem 36 is integral or fixed to the flange 50, such as by brazing or welding, and projects inwardly from the flange 50.

As noted above, surrounding the stem 36 is the housing or stem heatshield 38 that is spaced from the stem 36 to provide an air gap. The stem heatshield 38 also surrounds the first flow plate 40 attached to a downstream end of the stem 36, and the second flow plate 42 attached to a downstream end of the first flow plate 40. Attached to the downstream end of the second flow plate 42 are the plurality of injector modules 44, which are arranged in three linear groups, a first end group 60, a second end group 64 and a center group 62. The groups may be arranged at an angle relative to one another, such as a forty-five degree angle, to reduce interaction of the spray exiting the injector modules in one of the adjacent groups and to enhance flame stability.

Figure 6:
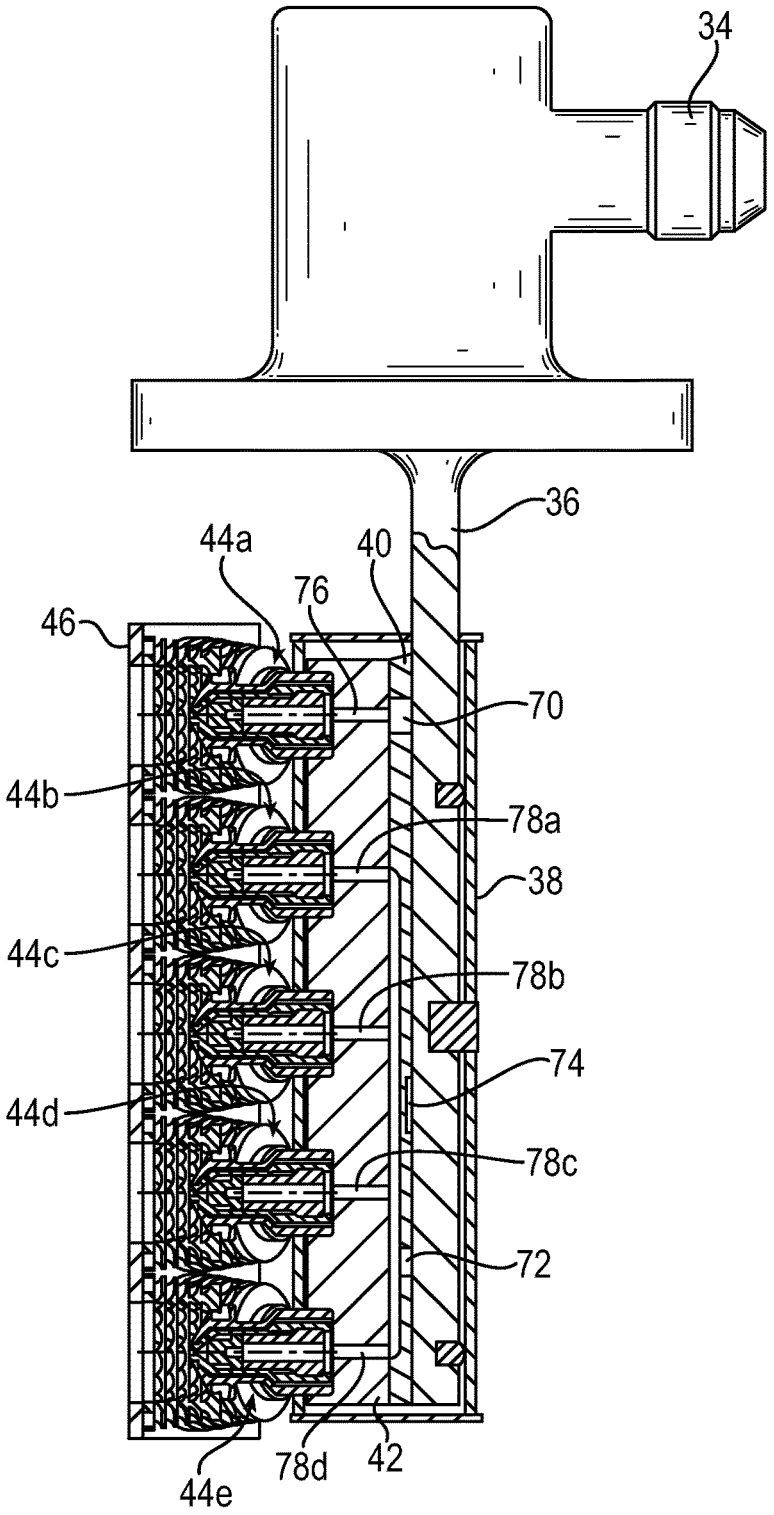
FIG. 6 is a fragmentary cross-sectional view of the exemplary fuel injector.

As shown in FIG. 6, the first flow plate 40 includes at least one flow passage, and in the illustrated embodiment a plurality of flow passages 70, 72, and 74 for receiving fuel from respective flow passages (not shown) in the stem 36. The flow passages in the stem are connected to a staging valve, for example in the valve housing 32, which is connected to the port 34 to receive fluid from the port. The first flow passage 70 serves as a pilot circuit typically for use during the entire engine operation, such as idle, low flow, etc. to maximum power. The first flow passage 70 directs the fluid to a first flow passage 76 in the second flow plate 42, which directs the fluid to the top injector module 44*a* in the center 62 of injector modules.

The second and third flow passages 72 and 74 serve as first and second main circuits typically for use separately or together as the engine reaches medium to maximum power conditions. The second flow passage 72 directs the fluid to a plurality of second flow passage 78*a*-78*d* in the second flow plate 42, which direct the fluid to the remaining injector modules 44*b*-44*e*, respectively, in the center group 62 of injector modules. The third flow passage 74 directs the fluid to a plurality of third flow passages, two of which are shown at 80*a* and 80*b* in the second flow plate 42 in FIG. 7, which direct the fluid to the injector modules in the first end group 60 and second end group 64 of injector modules. It will be appreciated that the injector 30 may include any suitable number of pilot and main circuits, such as first and second pilots and first and second main circuits, and the pilot(s) and main circuit(s) may flow to any suitable arrangement of the injector modules. It will also be appreciated that the injector may include any suitable number of valve housings, such as a first valve housing for the pilot circuit and a second valve housing for the main circuits.

Referring now to the heatshield 46 in detail, the heatshield 46 is attached to a downstream end of each injector module 44 for protecting the injector modules 44 from combustion heat, such as by restricting air flow around the modules. The heatshield 46 includes a body 90, which may include a thermal barrier coating and may optionally have a plurality of cooling holes 92 extending therethrough for relatively cool air to flow through to provide effusion cooling on a surface of the heatshield 46, and a plurality of openings 94 located so as to allow the fluid from a corresponding injector module 44 to be dispensed into the combustor 16.

The body 90 is formed by three elongated heatshield segments 100, 102, and 104 integrally formed or coupled in any suitable manner, each of which has a somewhat rectangular shape with an outer planar surface and adjoining and contiguous side edges. Each heatshield segment includes a plurality of the openings 94 arranged in respective linear, planar arrays, spaced evenly along a length of the respective segment 100, 102 and 104, and along about the median line of the segment. The injector modules 44 are correspondingly spaced along a length of the respective segment 100, 102, and 104 so that the injector modules 44 can float radially relative to adjacent injector modules 44 along a corresponding segment 100, 102, and 104 to relieve thermal stress, and can expand at high temperatures thereby filling the gaps between the injector modules. The injector modules may also float axially, for example by growing axially due to heat and moving the heatshield accordingly, and may also float in a transverse direction, for example by growing in the transverse direction due to heat. It will be appreciated that while shown as being in linear, planar arrays, the openings 94 may be arranged in any suitable arrangement. It will also be appreciated that each injector module may include its own heatshield that may be coupled to adjacent heatshields in any suitable manner.

Figure 7:
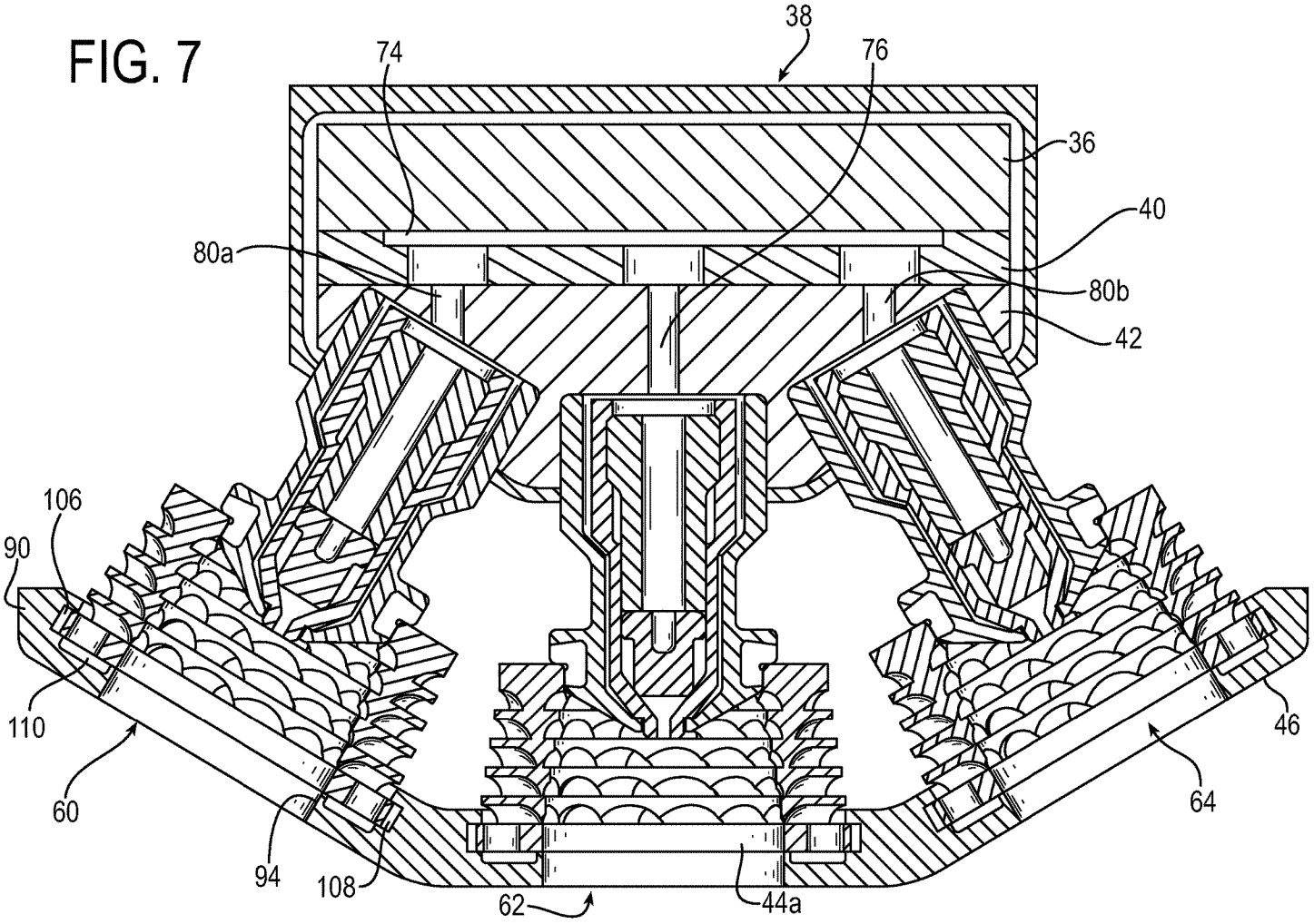
FIG. 7 is a top cross-sectional view of the exemplary fuel injector.

The heatshield 46 may be attached to the injector modules 44 in any suitable manner, such as by sliding the injector modules 44 into grooves 106 and 108 formed along a backside of the body 90. In an embodiment, the grooves 106 and 108 may be formed along the backside of each segment 100, 102, and 104, allowing the injector modules 44 to be radially spaced. The injector modules 44 may also be attached such that a portion of a second end of each injector module 44 is axially spaced from the heatshield 46, thereby defining an axial cooling gap 110 as shown in FIG. 7.

Figure 8:
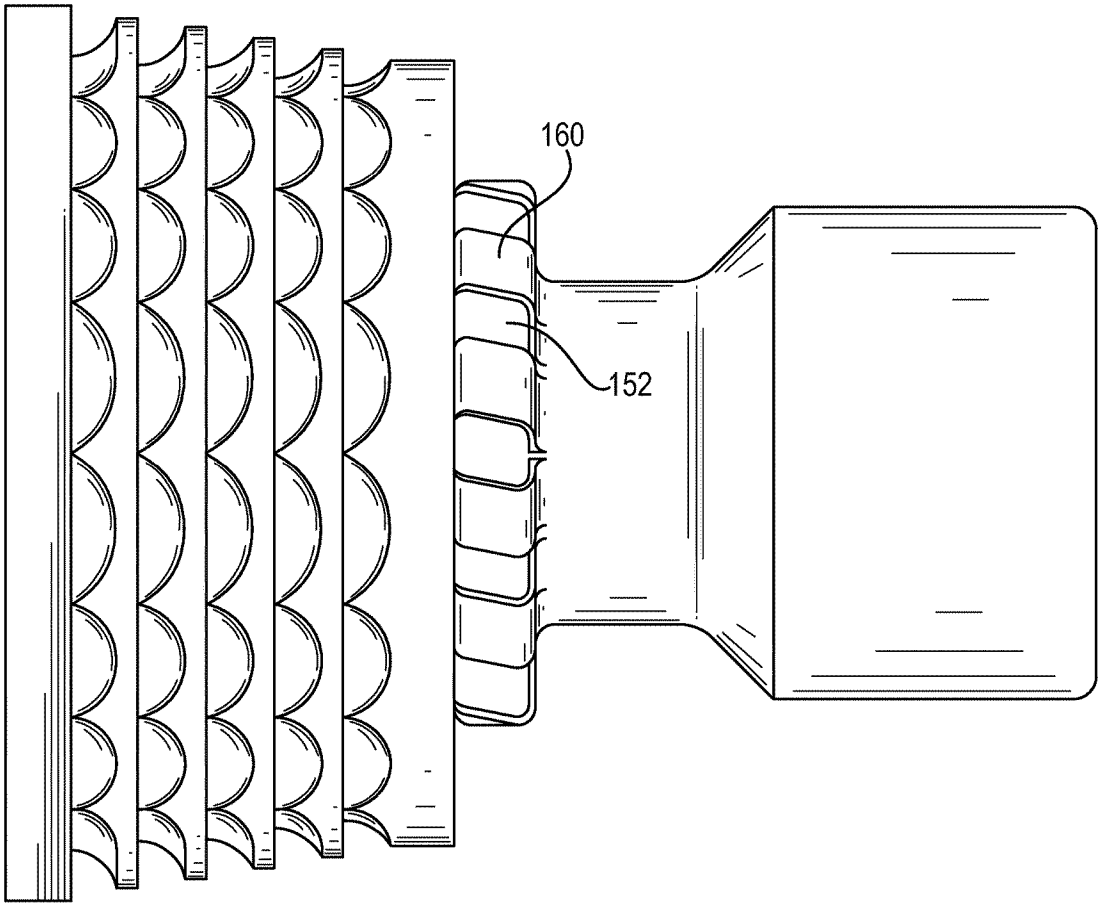
FIG. 8 is a perspective view of an exemplary injector module according to the invention.
Figure 9:
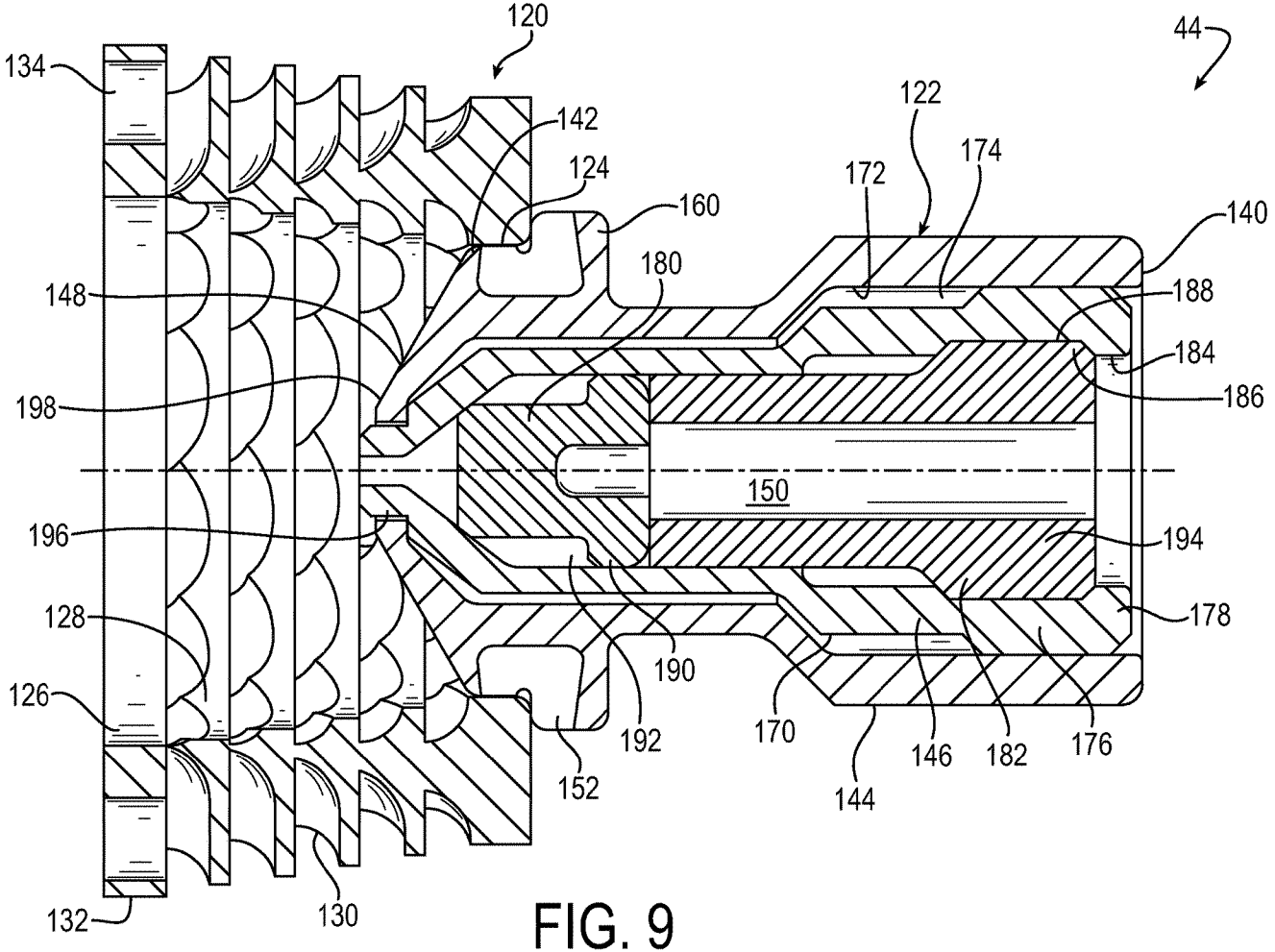
FIG. 9 is a cross-sectional view of the exemplary injector module.

Turning now to FIGS. 8 and 9, the micro-mixing injector module 44 will be discussed in detail. The micro-mixing injector module 44 includes a spray cup 120 and a pressure swirl atomizer 122 attached to the spray cup or integrally formed with the spray cup 120. The spray cup 120 may be a straight cup, a converging cup, or a diverging cup in a direction of flow as shown. The spray cup 120 has first and second open ends 124 and 126, a chamber 128 defined between the ends 124 and 126, and a plurality of radial air passages 130 extending through the spray cup 120 for directing air radially inwardly into the chamber 128. The plurality of radial air passages 130 extend through a wall of the spray cup 120 and are circumferentially spaced around the spray cup 120. The plurality of circumferentially spaced radial air passages 130 may include a plurality of sets of circumferentially spaced passages axially spaced from one another to provide for mixing of the fluid and axial air with radial air along the length of the spray cups 120.

The spray cup 120 also includes a flange 132 extending radially outwardly from the second end 126. First and second sides of the flange 132 may be received respectively in the grooves 106 and 108 in the heatshield 46 to secure the spray cup 120 to the heatshield. The flange 132 may include a plurality of holes 134 that may provide for stagnation cooling flow on the back side of the heatshield 46, and communicate with the cooling holes 92 in the heatshield 46 through the gap 110 to provide for effusion cooling flow through the heatshield 46. The cooling holes 92 provide for effusion cooling to reduce heat transfer between the combustion products and the heatshield 46, thereby reducing temperature gradients and thermal stresses in the spray cup and reducing wetted wall temperature in the atomizer tip.

Referring now to the pressure swirl atomizer 122, the pressure swirl atomizer 122 extends through the stem heatshield 38 and has a first end 140 attached to the flow plate 42, such as by brazing, and a second end 142 attached to the spray cup 120 at the first end 124, such as by brazing. The pressure swirl atomizer 122 includes a body 144, herein referred to as an outer body 144 that has a tip 148 extending into the chamber 128, an orifice body 146 that is surrounded by the outer body 144, a fluid passage 150 extending through the orifice body 146 for directing fluid, such as fuel, in an axial direction into the chamber 128, and at least one air passage 152 radially outwardly spaced from the fluid passage 150 for directing air around the pressure swirl atomizer 122 in the axial direction into the chamber 128.

The outer body 144 has at the second end 142 a plurality of circumferentially spaced projections 160 extending radially outwardly from the outer body 144. The at least one air passage 152, and in the illustrated embodiment a plurality of circumferentially spaced air passages 152, are formed between adjacent ones of the plurality of projections 160. The plurality of projections 160 may be straight or may be angled relative to the axis of the spray cup 120 as shown to swirl the air in the air passages 152. It will be appreciated that the projections may be formed according to known vane configurations, such as aerodynamic or curved helical vanes.

The orifice body 146 includes an outer wall 170 radially inwardly spaced from an inner wall 172 of the outer body 144 substantially along the length of the orifice body 146 to provide a heatshield gap 174 between the orifice body 146 and the outer body 144. The heatshield gap 174 shields the fluid in the fluid passage 150 by thermally isolating the fluid from air, such as the air flowing around the outer body 144 towards the air passages 152. To couple the orifice body 146 to the outer body 144, the orifice body includes a portion 176 at a first end 178 of the orifice body 146 that may be coupled to the inner wall 172 of the outer body 144 in any suitable manner, such as by brazing.

Disposed within the orifice body 146 are a plug 180 and a plug retainer 182. The plug retainer 182 abuts the plug 180 and is coupled to an inner wall 184 of the orifice body 146 in any suitable manner, such as by threads 188 that mate with threads 186 on the orifice body 146, to retain the plug 180 within the orifice body 146. The plug 180 includes a plurality of circumferentially spaced projections 190 extending radially outwardly from the plug 180 and contacting the inner wall 184 of the orifice body. A plurality of slots 192 are formed between the projections 190 to allow fluid to flow around the plug 180 and to swirl the fluid flowing past the plug 180. The plug retainer 182 includes a through passage 194 allowing fluid flow through the plug retainer 182. The through passage 194 in the plug retainer and the slots 192 of the plug define the fluid passage 150 through the orifice body 146.

The orifice body 146 also includes a tip 196 at a second end 198 of the orifice body 146. Both the second end 142 of the outer body 144 and the second end 198 of the orifice body may be conical, and the second end 198 of orifice body 146 converges within the outer body 144. The tip 196, which extends axially past the conical portion of the second end 196, extends through an opening in the tip 148 of the outer body 144 and past the tip 148 into the chamber 128. In this way, fluid flowing through the slots 192 converges towards the center of the orifice body 146 and is directed into the center of the spray cup 120. The distance the tips 148 and 196, and thus the fluid exit of the pressure swirl atomizer 122, extend into the chamber 128 may be varied based on application such that the fluid exit is recessed, flush, or protruding relative to the radial air passages 130 to control spray dispersion and combustion performance.

The micro-mixing injector modules 44 maintain lean combustion at high power conditions and may be straight, converging or diverging in a direction of flow, such as straight injector modules having non-swirling axial through flow, diverging modules having non-swirling radial inflow, etc. The micro-mixing injector modules may include swirling air inlets providing swirling through flow, non-swirling air inlets providing non-swirling through flow, or a combination thereof, where the swirl can be both clockwise or counter clockwise about the flow direction.

The micro-mixing injector modules may be fabricated in any suitable manner, such as by macrolamination, rapid prototyping, casting, machining, a combination thereof, etc., and may be formed by one or more components. The pressure swirl atomizers may be fabricated as a separate assembly from the spray cups, or integrated into the stem or spray cup. The heatshield may be fabricated in any suitable manner, such as by macrolamination, rapid prototyping, casting, machining, a combination thereof, etc., may be formed by one or more components, an may be integral with the micro-mixing injector modules.

During operation of the injector 30, fuel flows from a fuel supply through the valve housing and depending on engine operation, flows through one or more of the flow passages in the stem 36 to the pilot and/or main circuits. The fuel flows through the flow passages in the stem 36 into the respective flow passages 70, 72 and 74 and into the fluid passage 150 in the pressure swirl atomizer 122. The fuel is then directed axially out of the tip 196 in the orifice body 146 into the chamber 128. At the same time, air surrounding the injector 30 flows through the air passages 152 and is directed axially into the chamber 128, and the air flows through the radial air passages 130 radially inwardly into the chamber 128. The air from the air passages 130 and 152 mixes with the fuel in the chamber 128 and is directed out of the spray cup 120 at the second open end 126, through the opening 94 in the heatshield 46, and into the combustor 16.

By providing axial air flow and axial fuel flow into the chamber 128, the injector modules 44 provide improved atomization, enhanced combustion and increased effective area. By providing radial and axial air flow and axial fuel flow into the chamber 128, the fuel may be mixed to prevent local hot spots that lead to high NOx emissions, and a stable flame may be maintained without autoignition and flashback. The axial air flow also prevents recirculation zones from forming at the first end 124 of the spray cup 120, provides improved atomization, and enhanced combustion.

Figure 10:
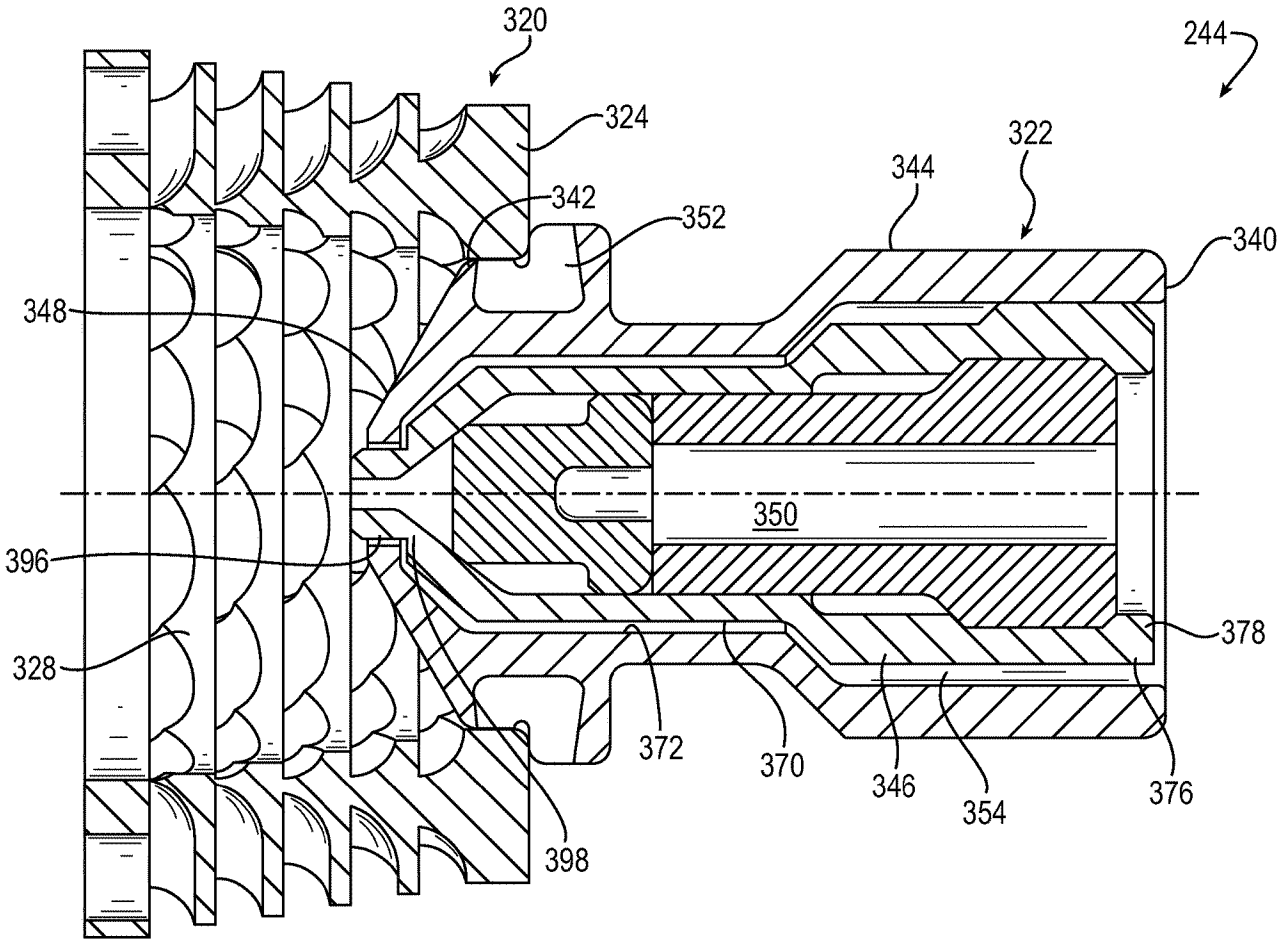
FIG. 10 is a cross-sectional view of another exemplary injector module.

Turning now to FIG. 10, an exemplary embodiment of the micro-mixing injector module is shown at 244. The injector module 244 is substantially the same as the above-referenced injector module 44, and consequently the same reference numerals but indexed by 200 are used to denote structures corresponding to similar structures in the injector module. In addition, the foregoing description of the injector module 44 is equally applicable to the injector module 244 except as noted below. Moreover, it will be appreciated upon reading and understanding the specification that aspects of the injector modules may be substituted for one another or used in conjunction with one another where applicable.

The micro-mixing injector module 244 includes a spray cup 320 and a pressure swirl atomizer 322 attached to the spray cup or integrally formed with the spray cup 320. The pressure swirl atomizer 322 extends through the stem heat-shield 38 and has a first end 340 attached to the flow plate 42, such as by brazing, and a second end 342 attached to the spray cup 320 at the first end 324, such as by brazing. The pressure swirl atomizer 322 includes a body 344, herein referred to as an outer body 344, having a tip 348 extending into the chamber 328, an orifice body 346 surrounded by the outer body 344, a first fluid passage 350 extending through the orifice body 346 for directing fluid, such as from a pilot circuit in an axial direction into the chamber 328, at least one air passage 352 radially outwardly spaced from the fluid passage 350 for directing air in the axial direction into the chamber 328, and a second fluid passage 354 radially outwardly spaced from the fluid passage 350 for directing fluid, such as a main circuit, in an axial direction into the chamber 328.

The second fluid passage 354 is provided between an outer wall 370 of the orifice body 346 and an inner wall 372 of the outer body 344. The orifice body 346 includes a plurality of circumferentially spaced projections 376 at a first end 378 of the orifice body 346 that may be coupled to the inner wall 372 of the outer body 344 in any suitable manner, such as by brazing. Slots (not shown) are provided between the projections 376 for the fluid to flow through to the second fluid passage 354. The orifice body 346 also includes a tip 396 at a second end 398 of the orifice body 346 that extends axially past the conical portion of the second end 396 and extends through an opening in the tip 348 of the outer body 344 past the tip 348 into the chamber 328. The tip 396 is spaced from the tip 348 such that fluid in the second fluid passage 354 may exit through the space between the tips into the chamber 328.

Figure 11:
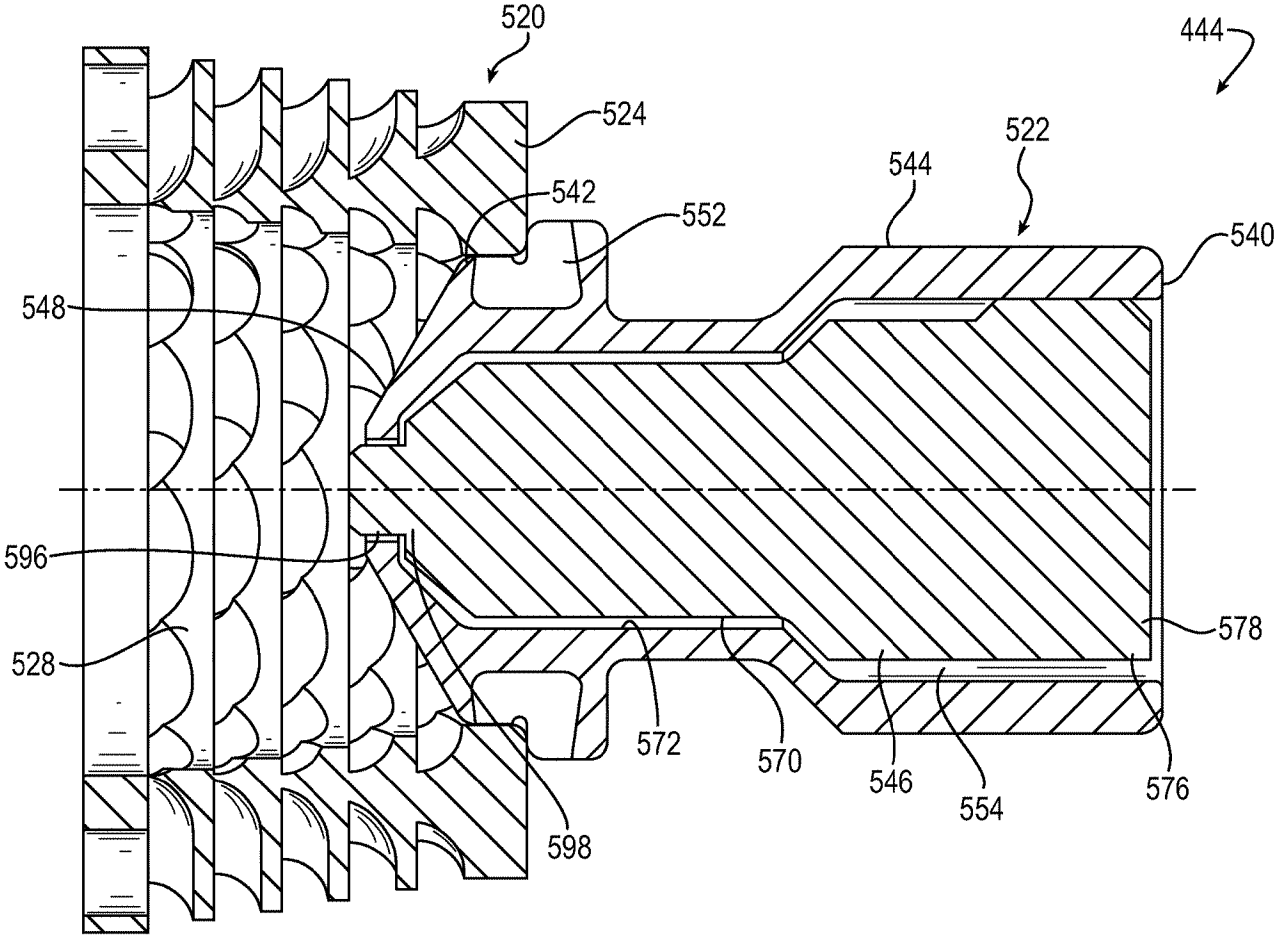
FIG. 11 is a cross-sectional view of still another exemplary injector module.

Turning now to FIG. 11, an exemplary embodiment of the micro-mixing injector module is shown at 444. The injector module 444 is substantially the same as the above-referenced injector module 244, and consequently the same reference numerals but indexed by 200 are used to denote structures corresponding to similar structures in the injector module. In addition, the foregoing description of the injector module 244 is equally applicable to the injector module 444 except as noted below. Moreover, it will be appreciated upon reading and understanding the specification that aspects of the injector modules may be substituted for one another or used in conjunction with one another where applicable.

The micro-mixing injector module 444 includes a spray cup 520 and a pressure swirl atomizer 522 attached to the spray cup or integrally formed with the spray cup 520. The pressure swirl atomizer 522 extends through the stem heat-shield 38 and has a first end 540 attached to the flow plate 42, such as by brazing, and a second end 542 attached to the spray cup 520 at the first end 524, such as by brazing. The pressure swirl atomizer 522 includes a body 544, herein referred to as an outer body 544, having a tip 548 extending into the chamber 528, an orifice body 546 surrounded by the outer body 544, a fluid passage 554 provided between an outer wall 570 of the orifice body 546 and an inner wall 572 of the outer body 544 for directing fluid in an axial direction into the chamber 528, and at least one air passage 552 radially outwardly spaced from the fluid passage 554 for directing air in the axial direction into the chamber 528.

The orifice body 546 includes a plurality of circumferentially spaced projections 576 at a first end 578 of the orifice body 546 that may be coupled to the inner wall 572 of the outer body 544 in any suitable manner, such as by brazing. Slots (not shown) are provided between the projections 576 for the fluid to flow through to the fluid passage 554. The orifice body 546 also includes a tip 596 at a second end 598 of the orifice body 546 that extends axially past the conical portion of the second end 596 and extends through an opening in the tip 548 of the outer body 544 past the tip 548 into the chamber 528. The tip 596 is spaced from the tip 548 such that fluid in the fluid passage 554 may exit through the space between the tips into the chamber 528.

Figure 12:
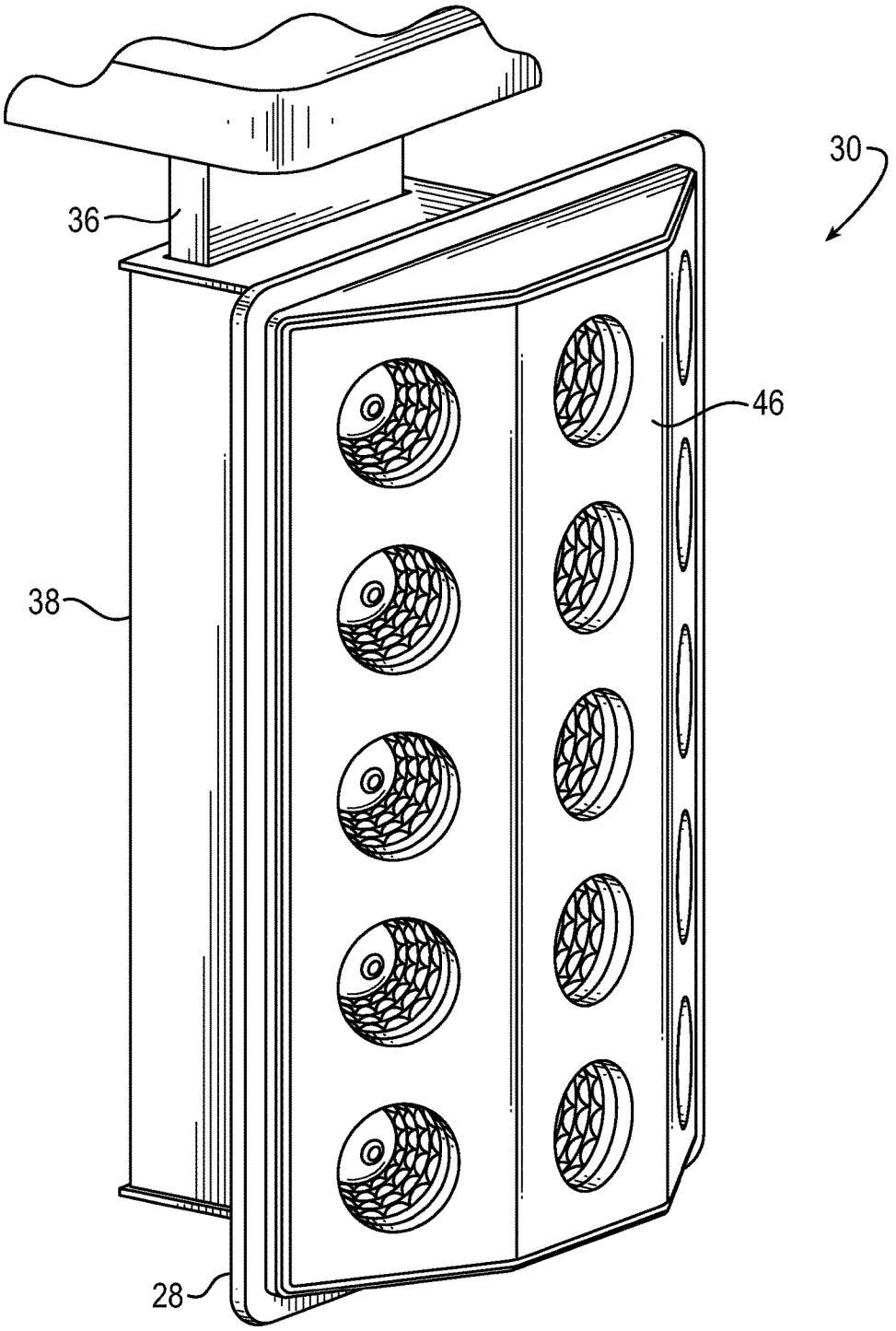
FIG. 12 is a perspective view of another exemplary injector.
Figure 13:
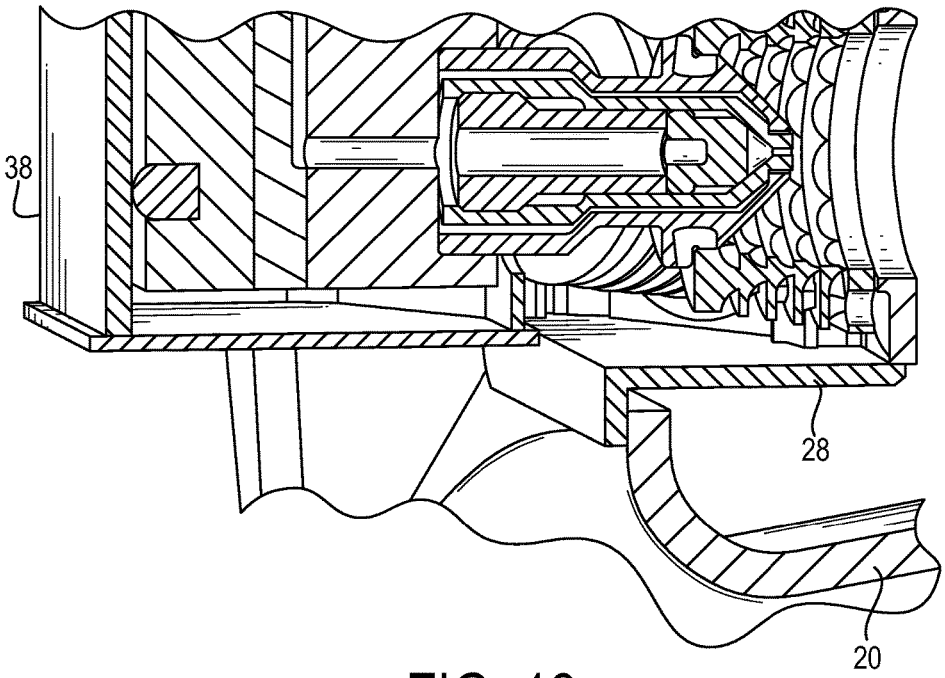
FIG. 13 is a cross-sectional view of the injector of FIG. 12 in communication with the combustor.

Turning now to FIGS. 12 and 13, the injector 30 may be assembled to the combustor dome 20 using a grommet 28 to allow the relative position of the injector 30 and opening in the dome 20 to float while restricting leakage of air flow around the injector 30 into the combustor 16. This allows for an accommodation of manufacturing tolerances and changes in geometry during operation at elevated temperatures and pressures, for example. As shown in FIG. 13, the grommet 28 and injector 30 are assembled with a relatively close fit, and the grommet 28 interfaces the dome 20 with a relatively loose fit within the injector opening in the dome 20, while bottoming on the face of the dome. The relatively loose fit within the dome opening allows the position of grommet 28 to float in the plane of contact. The pressure drop across the liner or other mechanical means act to bottom the grommet 28 against the dome 20 to maintain an axial seal, restricting air flow around the grommet 28 and into the combustor. A close sliding fit between the injector 30 and grommet 28 restrict air flow between the injector and grommet and into the combustor 16. The axial position of the grommet is fixed against the dome 20 and the sliding fit with the injector 30 may allow the injector to float in the axial direction.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An injector including:

a housing having a fluid channel for fluid;

a plurality of injector modules fluidly connected to the fluid channel, each injector module including:

a spray cup having first and second open ends, a chamber defined between the ends, and a plurality of radial air passages extending through the spray cup for directing air radially inwardly into the chamber; and a pressure swirl atomizer attached to the spray cup at the first end, the pressure swirl atomizer including a body having a tip extending into the chamber, a fluid passage extending through the body for directing fluid in an axial direction into the chamber, and at least one air passage radially outwardly spaced from the fluid passage for directing air in the axial direction into the chamber; and a heatshield assembled to a downstream end of each injector module, the heatshield including a body for protecting the injector modules from combustion heat and a plurality of apertures located so as to allow the fluid from a corresponding injector module to be dispensed from the spray cup;

wherein the plurality of apertures are spaced along a length of the heatshield in a direction perpendicular to the axial direction, and wherein the plurality of injector modules are spaced from one another in the direction perpendicular to the axial direction along the length of the heatshield such that the injector modules float radially relative to an adjacent one of the plurality of injector modules.

2. The injector according to claim 1, wherein the injector modules are configured to float axially and/or transversely.

3. The injector according to claim 1, wherein the heatshield includes a plurality of segments each including a plurality of apertures spaced along a length of the segment, wherein the segments are oriented in a side-by-side arrangement.

4. The injector according to claim 1, wherein an axial gap is provided between the heatshield and the second end of each of the spray cups.

5. The injector according to claim 1, wherein the heatshield includes a plurality of cooling holes extending through the body of the heatshield.

6. The injector according to claim 1, wherein each pressure swirl atomizer has a first end attached to the housing and a second end attached to the first end of the respective spray cup.

7. The injector according to claim 1, wherein the at least one air passage of each pressure swirl atomizer includes a plurality of circumferentially spaced air passages.

8. The injector according to claim 7, wherein each pressure swirl atomizer includes a plurality of projections extending radially outwardly from the body, and wherein the air passages are formed between adjacent ones of the plurality of projections.

9. The injector according to claim 7, wherein the plurality of projections are angled relative to the axis of the spray cup to swirl the air in the air passage.

10. The injector according to claim 1, wherein the plurality of radial air passages of each spray cup are circumferentially spaced.

11. The injector according to claim 10, wherein the plurality of circumferentially spaced radial air passages include a plurality of sets of circumferentially spaced passages axially spaced from one another.

12. The injector according to claim 1, wherein the tip of each pressure swirl atomizer is conical.

13. The injector according to claim 1, wherein the air from the radial air passages and the axial air passage of each injector module combines with the fluid from the respective fluid passage and is directed out of the spray cup through the second open end.

14. The injector according to claim 1, wherein each pressure swirl atomizer includes an inner body defining the fluid passage and an outer body surrounding the inner body, the outer body being attached to the first end of the spray cup.

15. The injector according to claim 14, wherein a heatshield gap is provided between the inner and outer bodies to shield the fluid in the fluid passage to isolate the fluid from air surrounding the outer body.

16. The injector according to claim 1, wherein the heatshield has grooves, and the downstream ends of the injector modules are slidably disposed in the grooves.

17. An injector comprising:

a housing having a fluid channel for fluid;

a plurality of injector modules fluidly connected to the fluid channel, each injector module including:

a spray cup having first and second open ends, a chamber defined between the ends, and a plurality of radial air passages extending through the spray cup for directing air radially inwardly into the chamber; and a pressure swirl atomizer attached to the spray cup at the first end, the pressure swirl atomizer including a body having a tip extending into the chamber, a fluid passage extending through the body for directing fluid in an axial direction into the chamber, and at least one air passage radially outwardly spaced from the fluid passage for directing air in the axial direction into the chamber; and a heatshield assembled to a downstream end of each injector module, the heatshield including a body for protecting the injector modules from combustion heat and a plurality of apertures located so as to allow the fluid from a corresponding injector module to be dispensed from the spray cup;

wherein the plurality of apertures are spaced along a length of the heatshield in a direction perpendicular to the axial direction;

wherein the plurality of injector modules are spaced from one another in the direction perpendicular to the axial direction along the length of the heatshield such that the injector modules float radially relative to an adjacent one of the plurality of injector modules; and wherein each spray cup includes a flange extending radially outwardly from the second end.

18. The injector according to claim 17, wherein the flange includes a plurality of air cooling holes for stagnation flow.

19. An injector comprising:

a housing having a fluid channel for fluid;

a plurality of injector modules fluidly connected to the fluid channel, each injector module including:

a spray cup having first and second open ends, a chamber defined between the ends, and a plurality of radial air passages extending through the spray cup for directing air radially inwardly into the chamber; and a pressure swirl atomizer attached to the spray cup at the first end, the pressure swirl atomizer including a body having a tip extending into the chamber, a fluid passage extending through the body for directing fluid in an axial direction into the chamber, and at least one air passage radially outwardly spaced from the fluid passage for directing air in the axial direction into the chamber; and a heatshield assembled to a downstream end of each injector module, the heatshield including a body for protecting the injector modules from combustion heat and a plurality of apertures located so as to allow the fluid from a corresponding injector module to be dispensed from the spray cup;

wherein the plurality of apertures are spaced along a length of the heatshield in a direction perpendicular to the axial direction;

wherein the plurality of injector modules are spaced from one another in the direction perpendicular to the axial direction along the length of the heatshield such that the injector modules float radially relative to an adjacent one of the plurality of injector modules; and wherein each spray cup diverges from the first end to the second end.

* * * * *